United States Patent [19]

Kindberg et al.

[11] Patent Number: 4,808,777

[45] Date of Patent: Feb. 28, 1989

[54] ELECTRIC SWITCH

[75] Inventors: Erik Kindberg, Tåstrup; Jan Lythcke-Jørgensen, Holte, both of Denmark

[73] Assignee: Aktieselskabet Laur. Knudsen Nordisk Elektricitets Selskab, Copenhagen, Denmark

[21] Appl. No.: 104,585

[22] Filed: Oct. 2, 1987

Related U.S. Application Data

[63] Continuation of Ser. No. 789,123, Oct. 18, 1985, abandoned.

[30] Foreign Application Priority Data

Oct. 25, 1984 [DK] Denmark ..... 5105/84

[51] Int. Cl.[4] ..... H01H 9/20

[52] U.S. Cl. ..... 200/323; 200/401; 200/501

[58] Field of Search ..... 200/76–78, 200/153 G, 153 P, 153 V, 153 SC, 318, 320, 321, 322, 324, 325, 327; 335/132

[56] References Cited

U.S. PATENT DOCUMENTS

| | | | |
|---|---|---|---|
| 3,488,609 | 1/1970 | Stokes . | |
| 3,495,198 | 2/1970 | Giger, Jr. . | |
| 3,562,463 | 2/1971 | Charbonneau | 200/153 P |
| 3,588,762 | 6/1971 | Willard . | |
| 3,632,933 | 1/1972 | McClain | 200/78 |
| 3,651,293 | 3/1972 | Hoffman | 200/153 P |
| 4,149,216 | 4/1979 | Kussy et al. . | |
| 4,336,520 | 6/1982 | Trayer | 200/153 G |

*Primary Examiner*—Charles E. Phillips
*Assistant Examiner*—Linda J. Shull
*Attorney, Agent, or Firm*—Cushman, Darby & Cushman

[57] ABSTRACT

An electric switch with a set of stationary contacts and a set of movable contacts situated on a contact bridge (30) between an IN-position and an OUT-position includes a forcibly guiding mechanism (32) for manual handling of the contact bridge (30) and an ejector mechanism (56) and a trip device (74) co-operating with the ejector mechanism, whereby the contact bridge (30) is automatically longitudinally displaced from its IN-position to its OUT-position when an overloading, a fault or a signal current is present. The forcibly guiding mechanism (32) and the contact bridge (30) are interconnected by means of a releasably blocking device in such a manner that the ejector mechanism (56) in the releasing state need only overcome frictional forces between the stationary and the movable contacts as the blocking device is released by means of the trip device (74). The forcibly guiding mechansim (32) and the ejector mechanism (56) co-operate in such a manner that the latter containing an energy reservoir such as a spring (64) is automatically reset before the contact bridge (30) can be forced to the IN-position. The forcibly guiding mechanism (32), in the form of an elbow joint, moves between two extreme positions and during such movement it passes a dead center. It includes a tilting spring (40) the potential energy of which after the passage of the dead center is utilized for charing the energy reservoir (64) of the ejector mechanism (56).

9 Claims, 7 Drawing Sheets

ELECTRIC SWITCH

Figure 1:
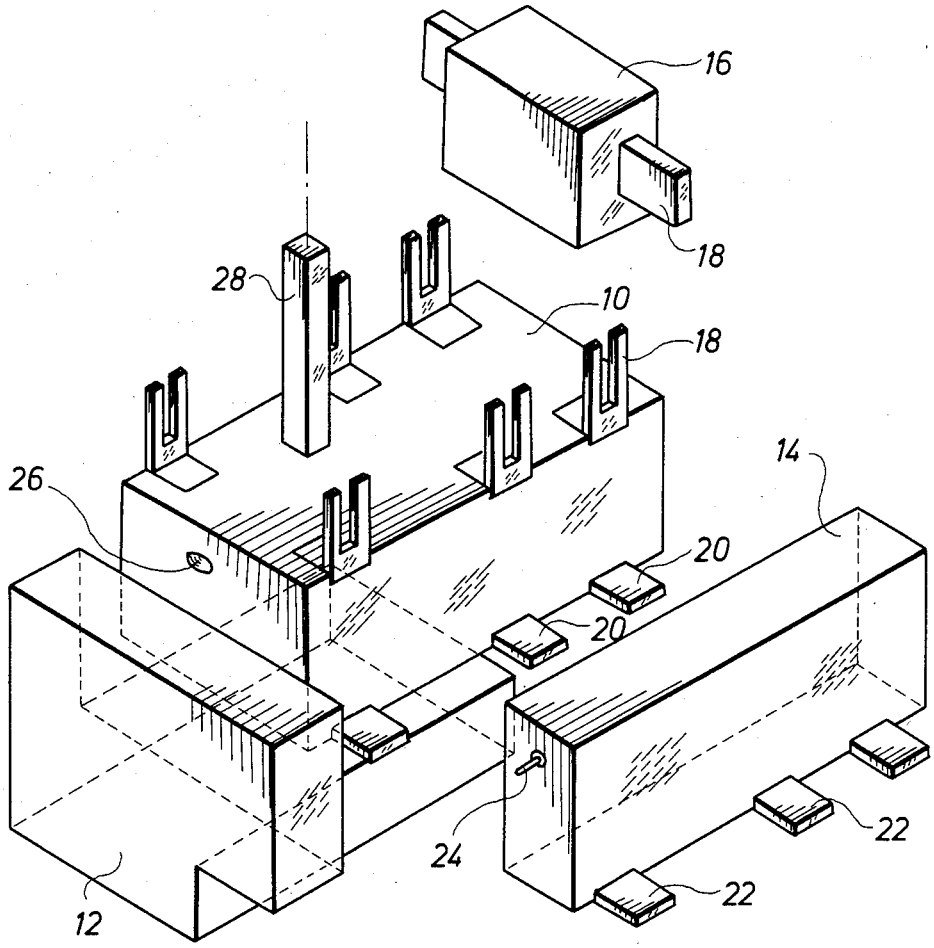

This is a continuation of application Ser. No. 789,123, filed Oct. 18, 1985, which was abandoned upon the filing hereof.

The invention relates to an electric power switch with a manual control handle rigidly connected to toggle means, whereby the electric switch furthermore comprises a set of fixed contacts and a corresponding set of displaceable contacts provided on a common contact bridge displaceable by means of the above carrier between an IN-position wherein all the contacts are closed and an OUT-position wherein all the contacts are open, said carrier projecting through an opening in the contact bridge.

A switch on the above type has been marketed for many years and is adapted to co-operate in series with a fuse-holder comprising safety fuses. The switch is of a simple and solid structure and per se it is not adapted to interrupt a possible short-circuit current. The simple mechanical structure provides in particular the advantage that the handle can never be transferred into the OUT-position without causing the displaceable contact bridge to follow in such a manner that the contacts are in fact disengaged. If the contacts are accidentally welded together, the handle is forced to return to the IN-position though a displacement has been attempted. The latter is an essential safety factor and is of great importance to an electrician who has to modify the installation and therefore has to transfer the handle to the disconnected position.

In connection with electric installations it can be desirable and necessary both to have a protection against major short-circuit currents as well as a protection against minor overloading currents. Here it is a question of two different types of protection. The first type of protection relates to major short-circuit currents and must be activated immediately so as to switch off the major current. Such a protection is efficiently obtained by means of safety fuses. A protection against minor, but nevertheless overloading currents need not always be activated immediately, and the current does not exceed limits allowing it to be disrupted in the general switch in an ordinary way by separating the movable contacts from the fixed contacts.

The object of the present invention is to provide an improved which can provide an automatic disconnection in case of an error indication from a unit provided for this purpose, e.g. on account of an overcurrent or a fault current.

Several switches for an automatic disconnection are already known. Such switches have inter alia been described in U.S. Pat. Nos. 3,488,609, 3,495,198, and 3,588,762. By the known switches the automatic disconnection has, however, been obtained at the expense of the security obtained by a switch of the type stated in the introduction to the specification. By the known switches with an automatic disconnection it is possible manually to place the handle in the OUT-position through the contacts have accidentally been welded together and therefore cannot break.

According to the invention a switch is provided of the type stated in the introduction to the specification, whereby the opening for the carrier means at one end is defined by a movable blocking means mounted on the contact bridge and usually locked in a blocking position by a locking means, and whereby ejector means are provided in extension of the displaceable contact bridge, whereby said ejector means are provided with an energy reservoir and through an impact action are capable of transferring the contact bridge from the IN-position to the OUT-position, and furthermore whereby a mechanical and/or electric releasing means is provided which in response to a predetermined action of mechanical or electric nature releases the movable, but until now locked blocking means and immediately thereafter releases the ejector means.

As releasing means release the blocking means the carrier means no longer restricts the position of the contact bridge, and the subsequent releasing of the ejector means actuates the contact bridge through a heavy impact in such a manner that said bridge is displaced and the contacts are disconnected at once.

The switch is preferably of the type where the opening is of such an extension in the displacing direction of the contact bridge that a predetermined slip exists between the carrier means and the contact bridge, said slip being utilized for compressing a spring preferably mounted on the second arm and in turn releasing its spring energy when the dead centre of the elbow joint has been passed during the turning movement of the handle. The extension of the opening in both ends of the contact bridge is preferably limited in such a manner that the carrier means just causes the contact bridge to follow when the spring has reached its maximum tension and the dead centre has been passed. By this embodiment the energy stored in the spring causes the contact bridge to enter the new position in such a manner that the switch is always either completely switched off or completely switched on. According to the invention the opening in the contact bridge has been extended so far on the other side of the movable blocking means that the carrier means may remain in the IN-position when the ejector means displace the contact bridge into the OUT-position. In this manner all the energy stored in the energy reservoir of the ejector means, i.e. preferably a spring, can be used for displacing the contact bridge thereby disconnecting the contacts. The manual handle remains in the IN-position. The disconnection can be easily indicated in another manner. Such indication of a disconnection combined with the IN-position of the manual handle informs the user immediately when an automatic disconnection has occurred.

In a preferred embodiment, the ejector means comprise an ejector rod displaceable in the longitudinal direction thereof and a presser bar in the end thereof. In the position of the switch said presser bar abuts the contact bridge. Behind the presser bar is a compressed spring capable of displacing the ejector rod, the presser bar and the compressed spring are retained by latching means only released under faulty conditions. In this manner a mechanism is obtained which is sim;ple to release. Furthermore by selecting a suitably strong spring it is possible to obtain a correspondingly heavy impct action in order to displace the contact bridge even if the contacts are welded together by heavy currents.

In an advantageous embodiment according to the invention the blocking position of the blocking means is to one side defined by a fixed stop on the contact bridge, and the movable blocking means is kept pressed against said fixed stop by a spring, preferably a tension spring, and the blocking means is retained in the blocking position to the second side of a spring-loaded ratchet arm. In this manner a well defined limitation of the free movement of the carrier means in the opening in the contact bridge is obtained at the same time as the blocking means is easy to release in one direction, viz, when an automatic disconnection is to take place.

Figure 2:
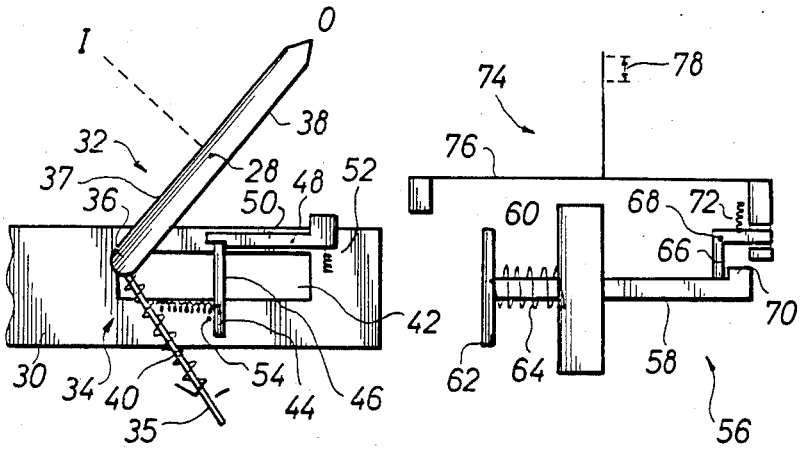
Figure 3:
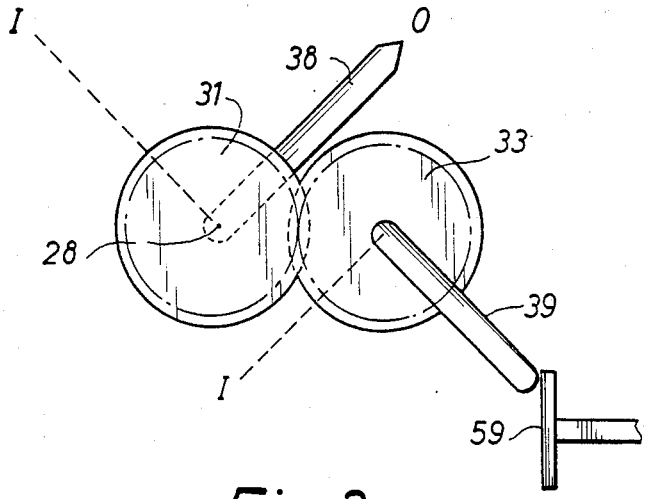
Figure 5:
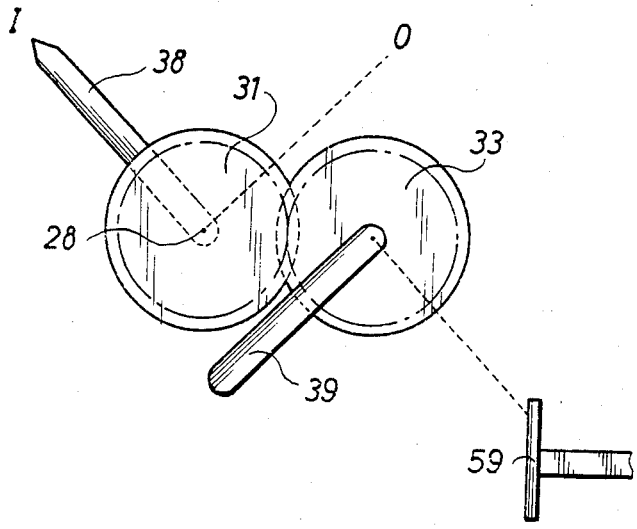
Figure 6:
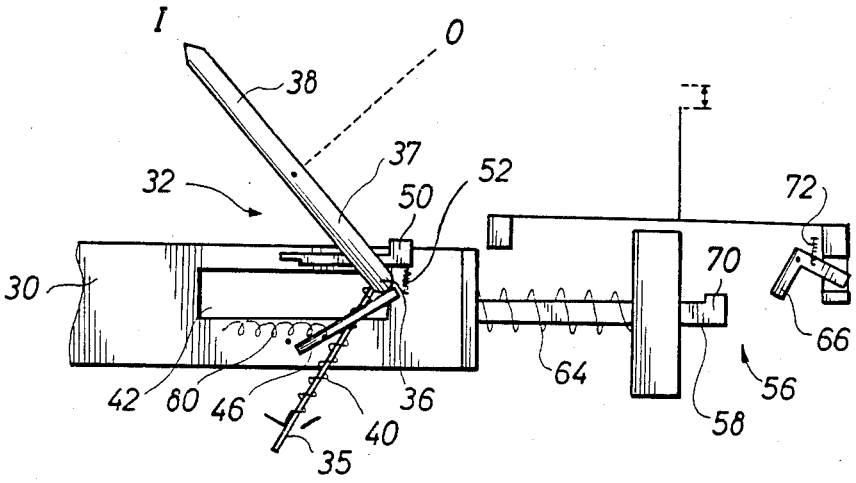
Figure 7:
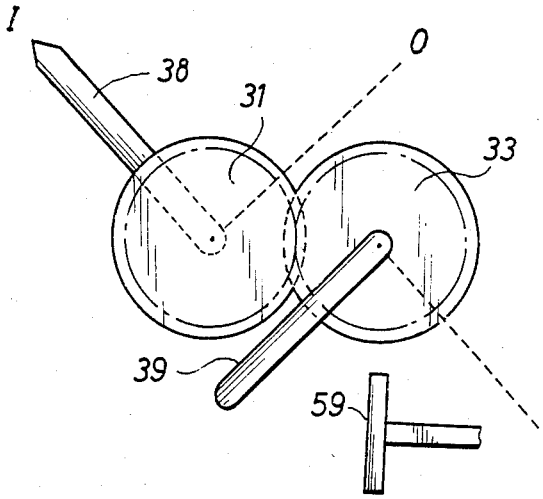
Figure 8:
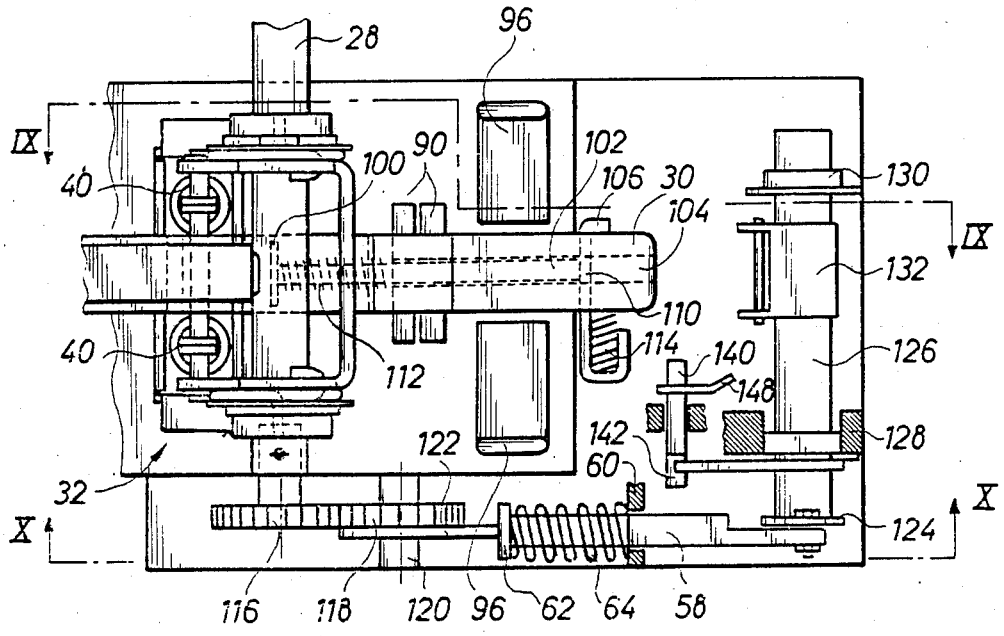

The invention will be described below with reference to the accompanying drawing, in which FIG. 1 illustrates the basic structure of an electric switch according to the invention, FIG. 2 is a diagrammatic view of the basic structure of the contact bridge, the forcibly guiding and ejector mechanism of the switch, whereby the contact bridge appears in a forcibly guided OUT-position, FIG. 3 is a rough view of the basic coupling between the forcibly guiding mechanism and the ejector mechanism corresponding to an OUT-position of the forcibly guding mechanism and with a reset releasing mechanism, FIG. 4 corresponds to FIG. 3, but whereby the contact bridge appears in a forcibly guided IN-position, FIG. 5 corresponds to FIG. 3, but illustrating the situation of FIG. 4, FIG. 6 corresponds to FIGS. 2 and 4, but whereby the contact bridge appears in a released OUT-position, FIG. 7 corresponds to FIGS. 3 and 5, but illustrating the situation of FIG. 6, FIG. 8 is a top view partly in section of a practical example of an embodiment of the disconnecting, forcibly guiding, and ejecting mechanism of the switch, whereby the contact bridge appears in an OUT-position, FIG. 8*b* same in the IN-position and FIG. 8*c* same in the release condition.

Figure 9:
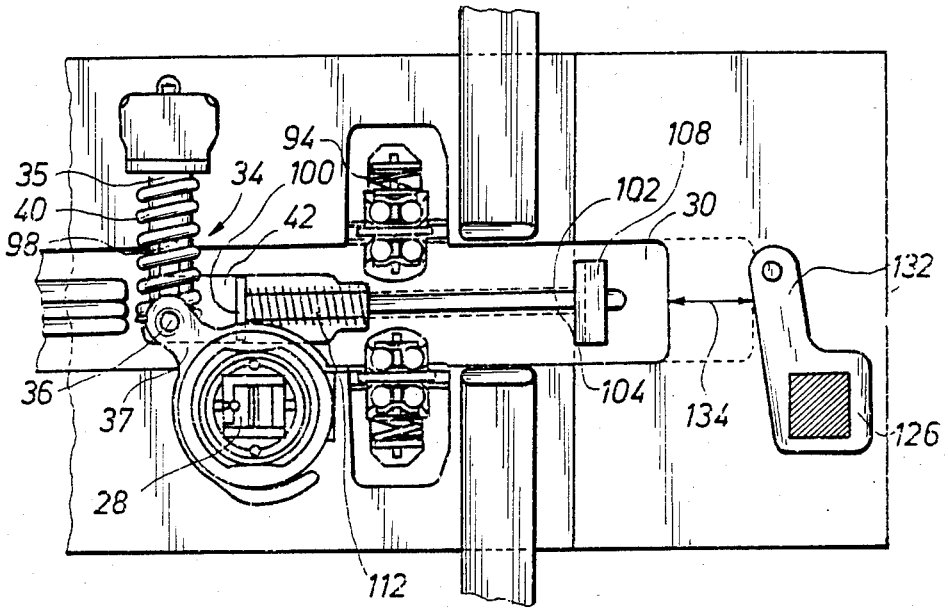

FIG. 9 is a sectional view taken along the line IX—IX of FIG. 8, FIG. 9*b* same in the IN-position and FIG. 9*c* same in released condition.

Figure 10:
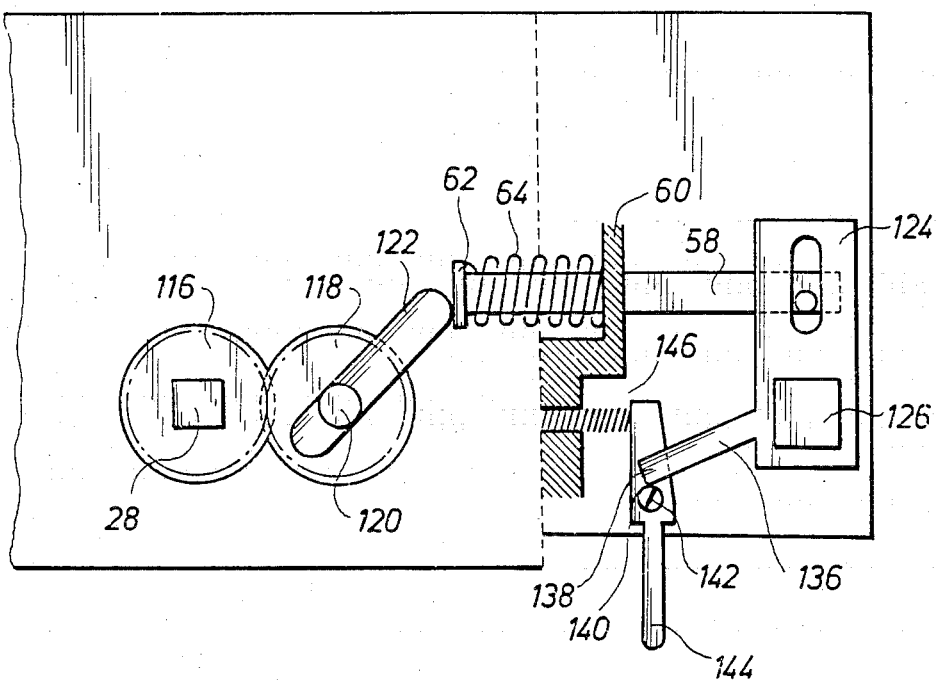

FIG. 10 is a sectional view taken along the line X—X of FIG. 8, condition FIG. 10*c* same in released and, FIG. 1 illustrates a rough view of the basic structure of a switch according to the invention. The switch is modularly structured and comprises substantially two mechanical and two electric units. The units appear separated. The two mechanical units include the switch module 10 and a releasing or tripping module 12, whereas the two electric units include a current-monitoring module 14 as well as an assembly of fuses 16, only a single fuse appearing in the drawing. The primary object of the fuses 16 is to protect against short-circuit currents, and they are connected to the switch module 10 through known terminal connections 18. The current-monitoring module 14 is connected to the switch module 10 through a set of connecting means 20 and to the voltage supply through a set of terminals 22. A corresponding set of terminals is provided on the other side of the switch module 10, said set, however, not appearing from the drawing. The current-monitoring module 14 communicates with the trip or releasing module 12 through an activating pin 24 triggering the releasing module 12 at the presence of an overloading, fault or signal current. In turn this module is mechanically connected to the switch module 10 through a hole 26 in one end wall of said switch module. The modular structure ensures a possibility of easily replacing parts involving a minimum consumption of expensive technician time. The modular structure forms no part of the present invention and has only been included in order to illustrate the field of application of the invention. The switch according to the invention operates consequently in such a manner that at the presence of strong short-circuit currents the current is interrupted by means of the fuses 16, whereas at the presence of less serious faulty or overloading currents or a signal current the current is interrupted by an activation of the trip or releasing module. Finally the switch module can be manually controlled by means of a handle shaft 28.

The connection between the basic structure of the units of the switch and releasing modules appears from FIGS. 2 to 7. The illustration is slightly diagrammatical for the sake of clarity and convenience, whereas a practical embodiment of the invention will be explained more detailed with reference to FIGS. 8 to 10.

The main member of a switch of the present type is a contact-carrying member causing one or more sets of contacts to engage and disengage one or more opposing current-collecting bars for the closing and opening of one or more paths and mounted in spaced relationship. The contact-carrying member i.e. the contact bridge is usually an elongated, bar-shaped body displaceable in its longitudinal direction in a guideway in the switch housing or the encasing of the module. In FIG. 2 the contact bridge is designated 30 and its displacing directions extend to the right and the left, respectively, of the Figure. The contact bridge 30 is manually controlled by means of a forcibly guiding toggle mechanism in general designated 32 and substantially comprising an elbow joint 34 on one or preferably on each side of the contact bridge 30 with a carrier 36 therebetween. The elbow joints and the related arms 35, 37 are particularly designed in such a manner that one arm is displaceably supported in one end while simultaneously compressing a tilting spring 40. One arm 35 of the elbow joint is pivotably and displaceably mounted in the switch housing whereas the second arm 37 is mounted on the handle shaft 38. The elbow joints 34 are operated through the handle shaft 28 manually turned by means of a handle designated 38 in FIGS. 2 to 6. The toggle spring is designated 40 surrounding the first arm 35 of the elbow joints between a fixed abutment and the carrier 36. The carrier 36 of the forcibly guiding toggle mechanism acts on the contact bridge 30 through an opening, other 42 therein. The path is of such an extent in the displacement direction of the contrast bridge that a predetermined slip exists between the carrier and the contact bridge. In FIG. 2, wherein the position of the handle 38 indicates an OUT-position "0" of the contact bridge 30, the carrier (engage) the left side of the opening 42. A releasable blocking 46 for the carrier 36 is provided midway in the opening, said blocking restricting the movement of the carrier within the opening. The blocking can be provided by means of a blocking arm 46 tiltably mounted about a projection or pivot 44 on the contact bridge 30, said blocking arm being retained in a fixed position (vertically shown in the Figure) by means of a ratchet arm or latch 50 rotatable about a second pivot 48 on the contact bridge. The ratchet arm 50 is maintained engaging the blocking arm 46 in a suitable manner, e.g. by means of a small compression spring 52. The further turning of the blocking arm 46 to the left of the Figure can be prevented by means of a stopping cam 54 on the side of the contact bridge.

The ejector mechanism of the switch is provided to the right of and spaced from the right end of the contact bridge 30 and is generally designated 56. It comprises an ejector rod 58 movable backwards and forwards in a bearing 60 in the switch housing. At the end facing the contact bridge the ejector rod 58 is provided with a presser bar 62 and is surrounded by an ejector spring 64 between said presser bar and the bearing, said ejector spring appearing compressed in FIG. 2. The ejector rod is retained by a second ratchet arm 66 pivotably mounted about a pivot 68 in the contact housing. The ratchet arm 66 engages the ejector rod 58 in the right end of said ejector rod at a suitable notch or projection 70 whereby it keeps the ejector spring 64 compressed. The ratchet arm 66 is retained in its position in a suitable manner for instance by means of a spring 72. The ejector rod 58 and the second ratchet arm 66 are provided with chamfered edges so as to allow them to interengage easily.

Above the ejector mechanism 56 a trip or activating device has been diagrammatically shown, said device releasing the ejector mechanism 56 and the blocking means 46 in the opening 42 of the contact bridge. The trip device is in general designated 74 and comprises substantially a member capable of simultaneously actuating the ratchet arm 50 on the contact bridge and the ratchet arm 66 in the ejector mechanism 56. The latter can be established in many ways and has in the drawing been symbolized by a rod or bridge-like member 76. The member 76 can be displaced in any transverse direction, but on the drawing the latter has been shown as an up-down movement, cf. the double arrow 78 simultaneously indicating the extent of the displacement and the force of the operating impact. The trip device 74 is suitably activated optionally by means of a force amplifying lever mechanism through the activating pin 24 in the current-monitoring module 14 of FIG. 1. The latter activation may for instance be established by a bimetal device or in any other known manner including said signal current.

In order to bring the contact bridge into its IN-position closing the actual current paths, the handle shaft 28 is turned counter clockwise by means of the handle 38. When the carrier 36 engages the blocking arm 46 retained in the vertical position shown by the ratchet arm 50, the contact bridge is forced into the other extreme position, viz. the IN-position, cf. FIG. 4, by a further turning of the handle 38. During the first half part of the procedure the toggle spring 40 is compressed until the arms 35 and 37 of the elbow joints are aligned. When this dead centre has been passed, the spring force will assist the movement of the carrier 36 and rapidly displace the contact bridge towards its IN-position. The toggle spring is also utilized in a suitable manner by resetting the ejector mechanism, cf. the explanation stated below. The handle 38 or a marker situated thereon points now at a marking such as "IN" or "ON" showing that the contact bridge is in the IN-position. This forced guiding with the associated indication of the position of the contact bridge 30 agrees completely with the provisions presented to manually operated switches.

Such manually operated switches are, however, according to the invention associated with an automatic, particularly structured disconnection device.

Figure 4:
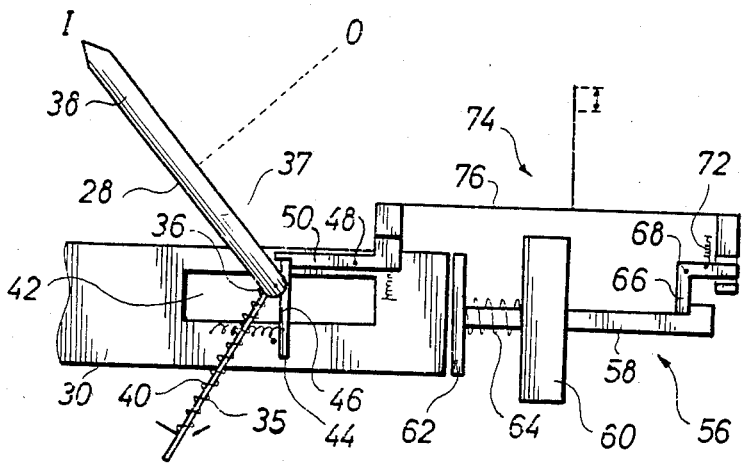

It appears from FIG. 4 that the ratchet arm 50 retaining the blocking arm 46 in the blocking position is positioned in such a manner in the IN-position of the contact bridge 30 that it can be actuated by the trip device 74 simultaneously with the ratchet arm 66 of the ejector mechanism 56.

When the trip device 74 is activated by the current-monitoring module 14 detecting an overloading, fault or signal current, the ratchet arm 50 on the contact bridge 30 as well as the ratchet arm 66 in the ejector mechanism 56 are actuated by a force directed downwards in FIG. 4 of the drawing making both ratchet arms turn clockwise about their pivots 48 and 68, respectively, whereby both the blocking arm 46 in the midway in the opening 42 of the contact bridge as well as the ejector rod 58 are released. The energy stored in the ejector spring 64 would, of course, be of such a magnitude that a disconnection will occur with certainty even in the case of a slight welding between the fused and movable contact. This energy is released and presses the presser bar 62 against the right end of the contact bridge 30. As the displacement of said bridge is no longer prevented by the blocking arm 46 and the carrier 36 the bridge is displaced to the left disengaging the fixed and movable contacts. FIG. 6 illustrates further that the forcibly guiding mechanism 32 does not change its position during the above procedure and that the handle 38 still indicates an IN-position of the contact bridge 30.

It is thus an essential feature of the invention that the forcibly guiding mechanism is disconnected from the bridge at the activation of the ejector mechanism, said procedure primarily reducing the need of potential energy in the ejector spring and secondly allowing a double indication for security purposes.

Accordingly in the situation of FIG. 6, the position of the contact bridge 30 does not correspond to the indication of the handle 38. In order to visualize the disagreement a second means can be established in association with the contact bridge, for indicating whether the contact bridge is in the IN- or the OUT-position. This second means is preferably realized by mechanical means in the form of a window in the switch housing. These mechanical means cooperate with coloured fields or markings on the sides of the contact bridge. Alternatively, the indications can be established by allowing the ends of the contact bridge alternately project outside the housing. Electrooptical or electromagnetic means may also be employed.

The above procedure implies a high security making mistakes almost impossible. Disagreeing signals indicate always that particular care should be taken. If the ejector mechanism 56 for instance has been activated in such a manner that the contact bridge is in the OUT-position, cf. FIG. 6, the auxiliary indicator shows that the bridge is out whereas the handle 38 indicates that the bridge is in. This disagreement is eliminated by returning the forcibly guiding toggle mechanism 32, i.e. by moving the handle 38 to the OUT-position because it is not possible until then to close the contacts, which procedure is always carried out by operating the forcibly guiding toggle mechanism manually.

At the same time as the forcibly guiding mechanism 32 is returned to the OUT-position, cf. FIG. 6, a so-called resetting of the ejector mechanism 56 takes place, whereby the ejector spring 64 is compressed again. The resetting can be carried out by means of a gear wheel mechanism operating between the forcibly guiding mechanism 32 and the ejector mechanism 56, said gear wheel mechanism comprising a first gear wheel 31 fixed on the handle shaft 38 and engaging a second gear wheel 33 mounted on the housing, cf. FIG. 7. An arm 39 is secured on the second gear wheel and co-operates with a bar 59 fixed on the ejector rod 58.

When the carrier 36 is returned to the left end of the opening 42, it is again possible for the blocking arm 46 to enter its blocking position in which it engages the ratchet arm 50 on the contact bridge, a small return spring 80 assisting in automatically raising the blocking arm 46. A second small return spring 52 ensures that the ratchet arm 50 does in fact engage the blocking arm 46. Not until after the above procedure it is possible to push the contact bridge 30 to the right of the Figure by means of the forcibly guiding mechanism 32.

In the IN-position the position of the gear wheel mechanism is as shown in FIG. 7. When the handle is turned towards the OUT-position "0", the first gear wheel 31 is turned clockwise and the second gear wheel counter-clockwise so as to carry the arm 39 through an angle into abutment against the bar 59 of the ejector rod 58. When contact has been established between the arm 39 and the bar 59, the forcibly guiding toggle mechanism 32 has carried out half of its movement and just passed the dead centre. During the further movement towards the OUT-position "0", the bar 59 and consequently the ejector rod 58 are pressed to the right of the Figure while simultaneously compressing the ejector spring 64 until the ratchet arm 66 in the ejector mechanism 56 again engages the ejector rod 58 at the projection 70. As previously mentioned the and the return spring 72 co-operate in ensuring the clicking in. The position of the gear wheel mechanism in the OUT-position of the forcibly guiding toggle mechanism appears from FIG. 3. The toggle spring 40 operates actively during the above procedure as the energy stored in the spring 40 during the first part of the movement of the elbow joint 34 upon the passage of the dead centre is transferred to the ejector spring 64. The fact that the toggle spring co-operates actively in the resetting of the ejector mechanism 56 is a very essential feature of the switch according to the invention as it involves less use of power on behalf of the operator when resetting the ejector mechanism. The inversion of the movement of the ejector rod provided by the gear wheel mechanism implies furthermore that the ejector mechanism has thereby been reset and made ready for operation already before the contact bridge 30 is forcibly guided into its IN-position. This procedure is an advantage concerning the security as a release can thereby be established already on a beginning stage of the forcibly guiding movement.

Subsequently the situation of FIGS. 2 and 3 appears. It is noted that the clicking in of the two ratchet arms 50 and 60 during the resetting of the ejector mechanism 56 occurs in two stages whereas the clicking out or release of the ratchet arms at the tripping (automatic release) occurs almost simultaneously as the release of the blocking arm 46 preferably occurs immediately before the ejector rod 58 is released.

When the contact bridge 30 is forcibly guided into the IN-position, the arm 39 disengages simultaneously the bar 59 of the ejector rod 58, cf. FIG. 5, whereby the ejector spring is not encoumbered by the friction in the gear wheel mechanism during the releasing.

While the invention has been explained above with reference to rough Figures, the invention will be explained below by means of a practical embodiment of the switch according to the invention, cf. FIGS. 8 to 10. FIG. 8 is a top view, partly in section, whereas FIGS. 9 and 10 are vertical sectional views taken along the lines IX—IX and X—X, respectively, of FIG. 8. The contact bridge 30 carries contact members 90, which for instance comprise silvered cobber rolls or rolls of another conductive material which in sets of two by two or four by four can be compressed by suitable compression springs 94, cf. FIG. 9, against the fixed contacts, 96 to be interconnected. Optionally said fixed contacts are integral with the terminals 18 and 20 of FIG. 1. Only the portion of the contact bridge 30 co-operating with the toggle mechanism 32 and the ejector mechanism 56 has been shown. The remaining portion carrying other contact members has not been shown as it presents no part of the invention. It appears that on both sides of the contact bridge 30 the handle shaft 28 carries one arm 37 of an elbow joint and therebetween the carrier 36 extending through the operating 42 of the contact bridge 30. The situation of FIGS. 8 to 10 illustrate the forced OUT-position of the contact bridge, cf. FIG. 2. The position of the contact bridge in the forced IN-position has been indicated by a dotted line in FIG. 9. The second arm 35 of the elbow joint comprises a slot 98 allowing a reciprocating sliding movement of the carrier against the effect of the toggle springs 40.

The blocking mechanism in the centre of the opening 42 of the contact bridge is a construction differing slightly from the mechanism of FIGS. 2 to 7. The blocking means comprises here a longitudinally displaceable stopping plate 100 in the opening situated at the end of a guiding rod 102. The guiding rod extends in a bore 104 extending in the longitudinal direction of the contact bridge. The movement of the guiding rod 102 is limited to the right of the Figure by a locking plate 106 displaceable up and downwards in FIG. 8 in a transverse recess 108 in the contact bridge 30. The locking plate 106 comprises a passage 110 which can be aligned in the releasing state with the guiding rod 102 in such a manner that the contact bridge can be displaced into the OUT-position without problems when a fault or signal current appears. A return spring for the stopping plate 106 is designated 112 whereas a return spring for the locking plate 106 is designated 114. If the contact bridge is to be transferable into a released position without involving the toggle mechanism, it is consequently necessary to raise the locking plate 106 so much that the guiding rod 102 can slide through the passage 110 of said plate 106.

The ejector mechanism 56 of the practical embodiment differs slightly from the mechanism of FIGS. 2 to 7 too.

As previously the ejector rod 58 with the presser bar 62 and the ejector spring 64 co-operate with the forcibly guiding toggle mechanism 32 through a pair of gear wheels 116 and 118. The first gear wheel 116 is situated on the handle shaft 28 whereas the second gear wheel 118 rotates about a fixed shaft or shaft pin 120 on the housing and engages the first gear wheel 116 permanently. The second gear wheel 118 carries an arm 122, the free end of which co-operates with the presser bar 62 of the ejector rod. As previously the ejector spring 64 operates between the presser bar 62 and a bearing 60. The opposite end of the ejector rod 58 is pivotably secured to the end of a lever arm 124 fixed on a transverse releasing shaft 126 behind the contact bridge 30. The releasing shaft 126 is pivotably mounted in a pair of bearings 128 and 130 in the housing.

An ejector arm 132 is fixed on the releasing shaft 126 and in the releasing situation it hits on the end of the contact bridge 30 in order to transfer said bridge into a released OUT-position, cf. the double arrow 134 of FIG. 9. The lever arm 124 is preferably longer than the ejector arm 132 as the force of the ejector spring 64 is thereby better utilized. Thus a release of the ejector spring causes the ejector rod 58 to pull the lever arm 124 and turn the releasing shaft 126 counter-clockwise in FIGS. 9 and 10. In this manner the ejector arm 132 follows the turning and is pressed against the end of the contact bridge 30 so as to displace said bridge to the left in the drawing.

In the reset position of the ejector mechanism 56 the ejector spring 64 is kept compressed by means of a blocking arm 136 also fixedly mounted on the release shaft 126. The blocking arm 136 is provided with a nose 138 resting on a trip shaft 140 opposite to a D-recess 142 provided therein. Furthermore a releasing arm 144 is mounted on the trip shaft comprises co-operating with the activating pin 24 of the current-monitoring module 14 of FIG. 1 for turning the trip shaft 140 at the presence of an overloading, a fault or a signal current. When the trip mechanism is trigged, the releasing arm 144 turns the trip shaft 140 counter-clockwise in FIG. 10 whereby the D-recess 142 is turned so much that the nose 138 of the blocking arm 136 is allowed to pass the trip shaft 148 and release the energy stored in the ejector spring 64. A return spring of the releasing arm 144 of the trip mechanism is designated 146. Furthermore a lifter 148 is made for rotation with the trip shaft 140. During this rotation the lifter 148 lifts the locking plate 106 to such an extent that the guiding rod 102 can pass through the passage 110 in said plate 106 in such a manner that the toggle mechanism 32 can remain in the IN-position when the contact bridge is released, i.e. corresponding to the situation of FIG. 6.

As described above with reference to FIGS. 2 to 7, the ejector mechanism 56 is now reset at the same time as the toggle mechanism 32 is moved to a position corresponding to the position of the contact bridge, i.e. into the OUT-position.

By the practical embodiment of the switch according to the invention the ejector mechanism is as previously mentioned reset/armed at the same time as the toggle mechanism 32 leaves the IN-position and enters the OUT-position.

The above inversion of the movement is effected by the two gear wheels 116 and 118. By turning the handle shaft 28 counter-clockwise in FIG. 10, the gear wheel 116 follows the turning and thereby forces the second gear wheel 118 with the arm 122 in the opposite direction, i.e. clockwise in the drawing. During this turning the arm 122 abuts the presser bar 62 and causes a compression of the ejector spring 64 and a return of the ejector rod 58 and the lever arm 124. Turning the releasing shaft 126 clockwise. During the latter movement the nose 138 is lifted whereby the trip shaft 140 and the releasing arm 144 situated thereon can be correctly positioned by means of the return spring 146. The lifter 148 has disengaged the locking plate 106/FIG. 8*c* which will be repositioned in the blocking position by means of the return spring 114 as soon as the guiding bar 102 has left the passage 110 in the locking plate. This movement takes place during the returning of the carrier 36 to the OUT-position as the return spring 112 of the stopping plate 100 presses said stopping plate to the left of the Figure.

In this manner the ejector mechanism has been reset and is ready for operation already before the contact bridge 30 is forced into its IN-position, which is an advantage as far as the security is concerned because then a releasing can take place already on an initial stage of the forced movement as mentioned previously.

It should again be emphasized that the toggle spring 40 assists in compressing the ejector spring 64 when the dead centre of the elbow joint 34 has been passed. The advantages obtained by such a procedure have been described previously.

The invention has been explained by means partly of some principal mechanisms and partly of a preferred embodiment of a switch, but it should be understood that many modifications are allowed within the scope of the invention. Thus the energy reservoir previously exemplified by a spring may for instance be a pneumatic mechanism capable of reacting as quickly as a spring.

We claim:

1. An electric power switch of the type including a switch housing, a manual control handle and at least two fixed contacts, one of which is electrically connected to an input terminal and the other connected to an output terminal, comprising:

longitudinally displaceable bar means including a moveable contact bridge having contact members for electrically connecting said fixed contacts in a first position and disconnecting said fixed contacts in a second position, said bar means being constrained against movement other than longitudinal movement of a guideway defined in said housing;

toggle means for moving said bar means between said first and second positions including first and second pivotable arms connected by a carrier means and an elbow joint, said carrier means protruding through a transversed opening in said contact bridge which limits movement of the carrier means with respect to said contact bridge;

ejector means for biasing said contact bridge away from said first position, said ejector means including a compression spring; and latching or locking means for retaining said ejector means in a position wherein said spring is tensed and ready for operation; whereby said opening is of such an extent in the displacement direction of the contact bridge that a predetermined slip exists between the carrier means and the contact bridge, said slip being utilized for compressing a spring that releases its spring energy when a dead center position of the elbow joint has been passed, and whereby the extension of the opening is defined in both ends thereof in such a manner that the carrier means causes the contact bridge to follow when the spring is compressed to a maximum and dead center has been passed, the improvement consisting in that a predetermined limiting surface inside the transverse opening in said contact bridge is engaged by said carrier when said switch is closed, said surface consisting of a displaceable blocking means moveably mounted when said contact bridge is lockable into a predetermined blocking position by locking means that are arranged to be released when a fault is detected, and wherein the opening in the contact bridge extends so far to the other side of the moveable locking member that the toggle means and carrier means can remain in their position when the ejector means is displacing the contact bridge in order to disconnect the moveable contacts from the fixed contacts.

2. A switch as claimed in claim 1, wherein the ejector mechanism comprises an ejector rod (58) displaceable in the longitudinal direction of said ejector mechanism and provided at one end with a presser bar (62) passed against the contact bridge (30) by a spring (64) in such a manner that it tends to press said contact bridge into the OUT-position, and whereby latching or blocking members are provided for retaining the ejector rod in a position ready for operation with a compressed spring.

3. A switch as claimed in claim 1, wherein the blocking position of the blocking member (46) to one side is defined by a fixed step (54), and the movable blocking member is kept abutting said fixed stop by a spring (80), and the blocking member is retained in the blocking position to the other side by a spring-loaded latch or pawl arm (50).

4. A switch as in claim 3 wherein said spring is a compression spring.

5. A switch as claimed in claim 1, wherein a transmission mechanism is provided which during a movement of the handle (38) from the IN-position thereof to the OUT-position thereof transfers mechanical energy to the energy reservoir of the ejector means.

6. A switch as claimed in claim 5, wherein the transmission mechanism comprises a plurality of gear wheels (31, 33), of which one gear wheel is mounted on the same shaft (28) as the handle (38) and the second gear wheel (33) is provided with a projecting arm (39, 122) actuating a displaceable bar (59, 62, 58), the displacement of which causes a feeding of energy to the energy reservoir of the ejector means.

7. A switch as claimed in claim 6, wherein the projecting arm is mounted on such a location of the circumference of the second gear wheel that the returning of the ejector mechanism and consequently the storing of energy in the energy reservoir are not initiated until the handle and the associated elbow joint has passed or almost passed the dead centre, i.e. not until after the energy reservoir associated with the elbow joint has accumulated energy and is ready to release energy.

8. A switch as claimed in claim 1, wherein the ejector mechanism comprises an ejector rod (58) displaceable in a first bearing (60) in the longitudinal direction, wherein one end of said ejector rod carrier a presser bar (62) co-operating with a manual control handle through a transmission in order to reset the ejector mchanism, and wherein the opposite end of said ejector rod actuates an ejector shaft (126) extending transverse to the displacement direction of the contact bridge (30) and furthermore carrying an ejector arm (32) co-operating directly with one end of the contact bridge (30) at the ejection, as well as blocking means, preferably in the form of a blocking arm (136) fixed on the ejector shaft (128) and co-operating with said ejector mechanism so as to retain the ejector shaft (126) and the ejector arm (132) in a position ready for operation and in which energy reservoir (64) is maintained charged.

9. A switch as claimed in claim 8, wherein the blocking comprises a stopping plate (100) displaceable in the mortise (42) and retained in a releasable blocking position by means of a guiding bar (102) extending through a longitudinal bore (104) in the contact bridge and locked in said blocking position by means of a locking plate (106) movable transverse to the guiding bar (102).

* * * * *